United States Patent [19]

Mee et al.

[11] Patent Number: 4,636,764

[45] Date of Patent: Jan. 13, 1987

[54] AUTOMATIC SECTIONALIZER

[75] Inventors: Geoffrey R. Mee, Kegworth; Philip Rosen, West Bridgford, both of England

[73] Assignee: Brush Fusegear Limited, Leicestershire, England

[21] Appl. No.: 756,173

[22] Filed: Jul. 18, 1985

[30] Foreign Application Priority Data

Jul. 18, 1984 [GB] United Kingdom ..... 8418342

[51] Int. Cl.[4] ..... H01H 71/10; H01H 71/20

[52] U.S. Cl. ..... 337/169; 337/175

[58] Field of Search ..... 337/168, 169, 171, 174, 337/170, 172, 173, 175, 401

[56] References Cited

U.S. PATENT DOCUMENTS 3,611,240 10/1971 Mikulecky ..... 337/169

4,045,762 8/1977 Foulkes ..... 337/401

*Primary Examiner*—Harold Broome

*Attorney, Agent, or Firm*—Charles E. Brown; Charles A. Brown

[57] ABSTRACT

An automatic sectionalizer for a power transmission line in which the actuator (8) operatively engages the tube (1) directly to cause it to move towards an isolating position.

9 Claims, 5 Drawing Figures

AUTOMATIC SECTIONALIZER

This invention relates to an automatic sectionaliser and in particular to a release mechanism for use with such a sectionaliser.

A sectionaliser of the general type with which the invention is concerned is described in U.K. patent specification No. 2 120 876 A. Sectionalisers of this type are designed for loading into the fixed portions of expulsion fuse cut-outs in place of conventional expulsion fuse carriers. The sectionaliser consists of an electrically conductive tube (of similar dimensions to the insulating carrier tube of an expulsion fuse) to which are affixed contact assemblies which engage with the corresponding fixed contacts of the expulsion fuse base. The sectionaliser tube carries an external current passing through the conductive tube. Under certain predetermined fault conditions the sectionaliser is activated so as to interrupt the circuit and thereby isolate or 'sectionalise' that portion of the distribution line with which it is associated. Activation is accomplished by discharging a capacitor into a chemical actuator or striker-type device which ejects a pin from its body with considerable force.

In previously produced sectionalisers, the emerging pin strikes some form of mechanical release mechanism attached to the sectionaliser thereby causing it to delatch from the fixed expulsion fuse contacts and swing down to the isolating position (in a similar manner to that occuring in a conventional expulsion fuse when its fusible element has melted).

According to the broadest aspect of the present invention there is provided an automatic sectionaliser in which the actuator operatively engages the tube directly to cause it to move towards an isolating position.

The engagement of the actuator upon the tube may be by way of a contact spring secured to the tube body for example by welding or rivetting. The contact spring may be curved to conform generally to the curvature of the tube body. Alternatively the contact spring may be straight initially and deformed to a curved condition when the sectionaliser is loaded.

Figure 1:
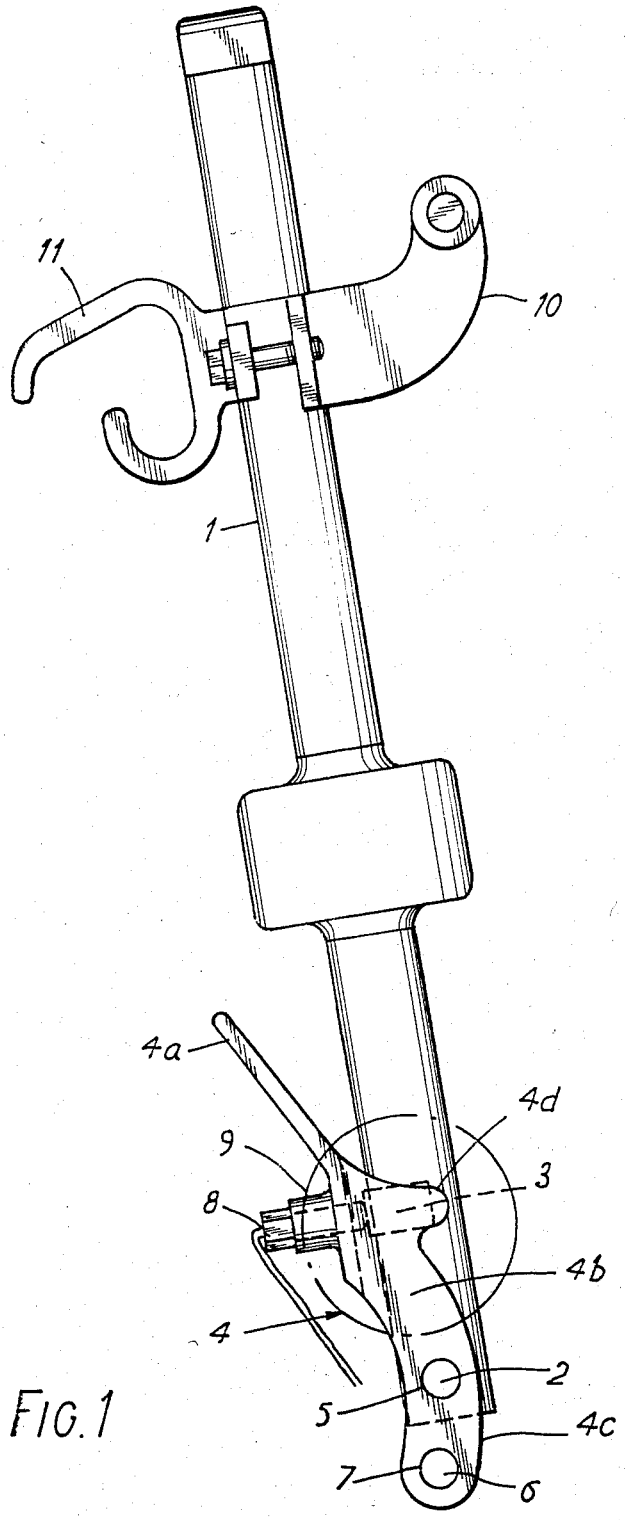
Figure 2:
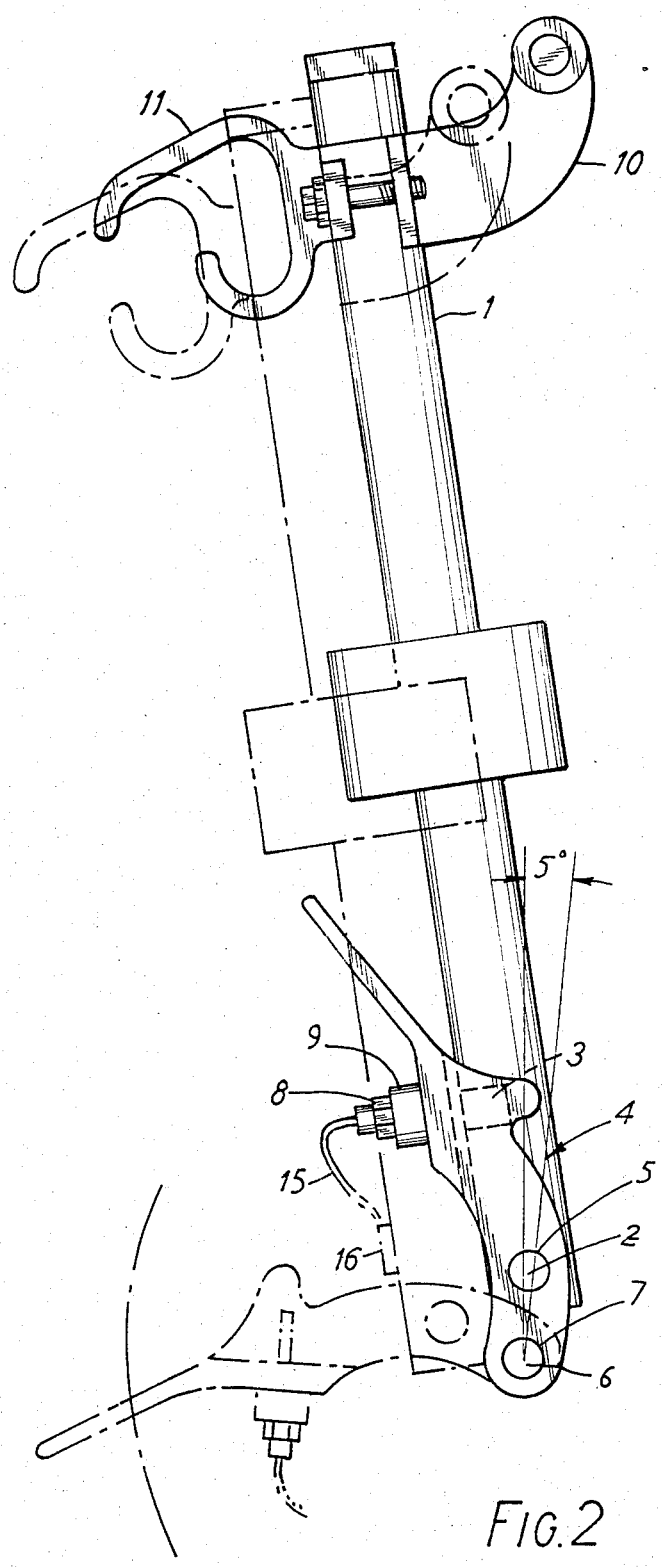
Figure 3:
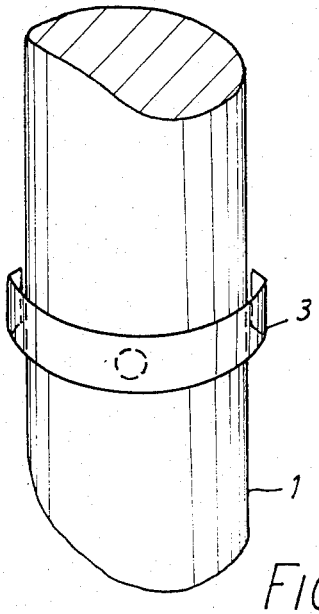
Figure 4:
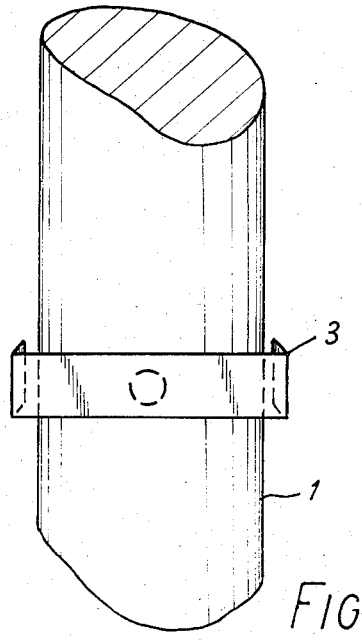
Figure 5:
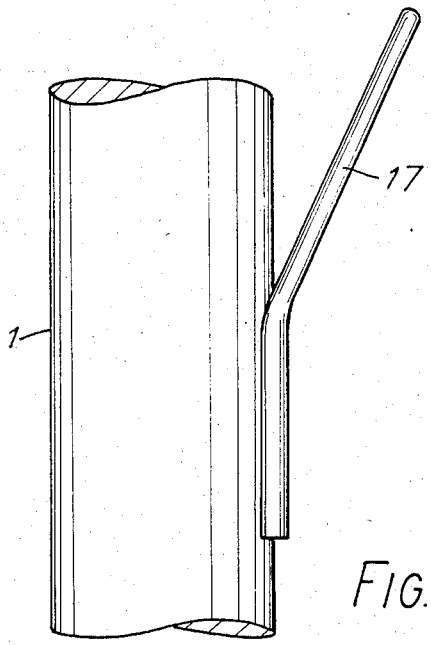

The invention will now be described further by way of example with reference to the accompanying drawings in which:

FIG. 1 is a side elevational view of an automatic sectionaliser incorporating a release mechanism in accordance with the invention, FIG. 2 is a similar view to that of FIG. 1 but showing diagramatically the sectionaliser in a loaded full line position and an operated but partially released position in broken outline, FIG. 3 is an enlarged view of that part of FIG. 1 shown in dotted outline showing particulars of a spring connection, FIG. 4 is a view similar to that of FIG. 3 of a straight contact spring, and FIG. 5 is a broken away view of the lower part of a carrier tube showing the use of an additional tang.

A pair of pivot bosses 2 and a spring contact 3 are secured to the tube 1 by brazing but it will be apparent that rivetting or other suitable means could be employed. The release toggle 4 is in one-piece and may be cast or fabricated from strip. The toggle has a central portion 4*b*, on one end of which is located a tang 4*a* and on the other end of which are located a pair of spaced limbs 4*c*. The limbs 4*c* of the toggle are each provided with a pair of apertures 5 which are received in the respective pivot bosses 2 to provide the toggle with a pivotting action. The tang 4*a* enables a cup fitted to an operating pole to raise the sectionaliser to its service position.

The free ends of the toggle limbs 4*c* are fitted with a pivot pin 6 received as a press fit in holes 7. A chemical actuator 8 is screwed into a tapped boss 9 on the central portion 4*b* of the toggle. The upper part of the central portion 4*b* adjacent the tapped boss 9 has a pair of arms 4*d* which are spread apart by a distance slightly in excess of the diameter of the tube 1. A contact spring 3 is secured to the tube at the height of the arms 4*d* so that when the toggle 4 is raised to a loaded condition, the arms 4*d* firmly engage the spring 3 as later described. If desired, the inner sides of the arms 4*d* may each carry a small pip-like protuberance (not shown) which engages with the spring 3 and behind which the spring 3 is secured when the toggle is loaded.

The flying connection leads 15 from the actuator are secured to a terminal block 16 either within or at base of the sectionaliser tube in known manner.

The upper end of the carrier tube is fitted with an adjustably slidable contact assembly 10 and hook-eye 11 which, in the illustrated embodiment are in two parts, clamped together about the tube so as to be adjustable to any required position along the upper portion of the carrier tube.

The operation of the sectionaliser is as follows:

The actuator 8 is first screwed to the illustrated position and its lead connected to the terminal block. The tang 4*a* (on the release toggle) and the carrier tube are then squeezed together by hand so that the inner face of the toggle is in contact with the adjacent face of the carrier tube by way of the curved contact spring 3, details of which may be seen in FIG. 3. The spring 3 which is of an electrically conducting material (beryllium-copper, phosphor-bronze or the like) performs three separate functions viz:

(a) its spring pressure against the side arms 4*d* of toggle hold it firmly in position during loading and normal service, (b) it provides an alternative electrical connection between carrier tube and release toggle thus avoiding any possibility of arcing at the pivot points, and (c) it acts an an anvil for the emerging actuator pin, thus avoiding possible local deformation of the walls of the carrier tube by the actuator pin.

As an alternative to using the curved spring shown in FIG. 3, an initially flat spring as shown in FIG. 4 may be used, the spring adapting a curved condition when bent by the arms 4*d* on the toggle 4.

The tang 4*a* is inserted into the cup on the end of a linesman's operating pole. The sectionaliser is then lifted to a location adjacent its service position. With the sectionaliser retained on the cup of the linesman's pole, the pivot pins are lowered into the jaws of the lower contact assembly of the expulsion fuse mount. The cup is then removed. The linesman's pole is then used to swing the sectionaliser into the vertical loaded position and the upper contact assembly 10 pushed-home to engage and latch into the fixed upper contacts of the explusion fuse mount.

In a variant of the sectionaliser shown in FIG. 5, a further tang 17 is rigidly secured by rivetting or brazing to the tube 1. By means of the tang 17, the sectionaliser may be manually loaded by use of a linesman's pole as described above. The use of the additional tang is highly desirable in situations where there is restricted access owing to the pressure of the pole upon which the sectionaliser and its carrier are mounted.

Reference to FIG. 2 shows that since holes 5 and 7 are off-set with respect to each other, in the normal service position, the carrier tube is held in a slightly 'over-centre' position and so cannot accidentally swing free. The slightly 'over-centre' position is approximately 50°.

In the event that the sectionaliser operates to isolate its part of the system following an electrical fault condition, the chemical actuator is fired and its pin ejected to a distance of approx. 10 mm. The pin impinges on the spring 3 and the reaction forces the tube and release toggle to swing apart about the pivot 5. The tube, no longer being held over-centre now commences to drop down, as shown in broken line in FIG. 2, thus de-latching from the upper fixed contact assembly. The sectionaliser assembly now freely swings down to the isolating position.

To re-instate the sectionaliser following such an operation, the operating pole is again engaged in the tang 4*a* or tang 17 as the case may be, the sectionaliser is lifted down to the ground and a new actuator fitted in place as previously described and the sectionaliser lifted back into position and re-latched.

Amongst the particular advantages of the invention is the facility it affords of making the sectionaliser compatible with a wide variety of commercially available expulsion fuse mounts. In general it is only necessary to vary the position of the upper contact assembly along the carrier tube and in some special cases vary the diameter of the pivot pin 6 or the contour of upper contact 10. Thus, a single sectionaliser unit with possibly one or two additional alternative parts may be used in conjunction with a number of different designs of expulsion fuse cut-out.

Further advantages of the invention are that it allows a simple robust construction with a minimum of moving parts and that the release action (being solely dependent on its reaction between tube and actuator pin) is positive and reliable.

We claim:

1. An automatic sectionaliser comprising a carrier tube, a toggle having a pivotal mount, a pivotal connection between said toggle and said carrier tube with said toggle supporting said carrier tube for movement between a loaded position and an isolating position, the relationship between said pivotal mount and said pivotal connection being one wherein said carrier tube is held in an over-center position when in said loaded position, and an actuator carried by said toggle for effecting relative pivoting between said toggle and said carrier tube and to cause said carrier tube to be displaced from said loaded position towards said isolating position, said actuator including an actuator body and a pin normally lying within said actuator body, and actuator means within said actuator body operable on said pin to eject said pin from said actuator body with said pin being operable on said carrier body.

2. A sectionaliser as set forth in claim 1 wherein the extent of said over-center is about 5 degrees.

3. A sectionaliser as set forth in claim 1 wherein a contact spring is secured to said carrier tube for engagement by said toggle to hold said carrier tube in said loaded over-center position.

4. A sectionaliser as set forth in claim 3 wherein said contact spring is curved to conform generally to the curvature of said carrier tube.

5. A sectionaliser as set forth in claim 3 wherein the portion of the contact spring to be engaged by said toggle is straight initially but which is deformed into a curved condition when the sectionaliser is loaded.

6. A sectionaliser as set forth in claim 3 wherein the contact spring is of an electrically conducting material and provides an electrical connection between said carrier tube and said toggle.

7. A sectionaliser as set forth in claim 1, wherein said toggle includes a tang by means of which the sectionaliser can be moved manually from said loaded position to said isolating position by means of a linesman's operating pole.

8. A sectionaliser as set forth in claim 7 wherein a further tang is provided, said further tang being rigidly secured to said carrier tube, said further tang forming means by which the sectionaliser can be manually loaded by means of a linesman's operating pole.

9. A sectionaliser as set forth in claim 1 wherein said carrier tube has an upper end which mounts an adjustably slidable contact assembly to enable the sectionaliser to be rendered compatible with an existing fuse mounting.

* * * * *